US007128790B2

(12) United States Patent
Waeckerle et al.

(10) Patent No.: US 7,128,790 B2
(45) Date of Patent: Oct. 31, 2006

(54) IRON-COBALT ALLOY, IN PARTICULAR FOR ELECTROMAGNETIC ACTUATOR MOBILE CORE AND METHOD FOR MAKING SAME

(75) Inventors: Thierry Waeckerle, Nevers (FR); Lucien Coutu, Sauvigny les Bois (FR); Marc Leroy, Antony (FR); Laurent Chaput, Sauvigny les Bois (FR); Hervé Fraisse, Nevers (FR)

(73) Assignee: Imphy Ugine Precision, Puteaux (FR)

( * ) Notice: Subject to any disclaimer, the term of this patent is extended or adjusted under 35 U.S.C. 154(b) by 231 days.

(21) Appl. No.: 10/275,814

(22) PCT Filed: May 11, 2001

(86) PCT No.: PCT/FR01/01440

§ 371 (c)(1),
(2), (4) Date: Feb. 14, 2003

(87) PCT Pub. No.: WO01/86665

PCT Pub. Date: Nov. 15, 2001

(65) Prior Publication Data

US 2004/0099347 A1 May 27, 2004

(30) Foreign Application Priority Data

May 12, 2000 (FR) ..... 00 06088

(51) Int. Cl.
*H01F 1/147* (2006.01)

(52) U.S. Cl. ..... 148/120; 148/121; 148/311

(58) Field of Classification Search ..... 148/120, 148/121, 311
See application file for complete search history.

(56) References Cited

U.S. PATENT DOCUMENTS

| | | | | |
|---|---|---|---|---|
| 3,892,604 | A * | 7/1975 | Thornburg et al. | 148/120 |
| 3,977,919 | A * | 8/1976 | Foster et al. | 148/121 |
| 4,120,704 | A | 10/1978 | Anderson | |
| 5,817,191 | A * | 10/1998 | Emmerich et al. | 148/311 |

FOREIGN PATENT DOCUMENTS

| | | |
|---|---|---|
| EP | 715 320 | 6/1996 |
| FR | 2 406 876 | 5/1979 |
| WO | WO 96 19001 | 6/1996 |
| WO | WO 01/00895 A1 * | 1/2001 |

OTHER PUBLICATIONS

Patent Abstracts of Japan, vol. 18, No. 251 (C-1199), May 13, 1994 & JP 06 033199 A (Hitach Metal Precision Ltd.), Feb. 8, 1994.
Patent Abstracts of Japan, vol. 1998, No. 1, Jan. 30, 1998 & JP 09 228007 (Toshiba Corp; Toshiba Electronic Eng. Corp.), Sep. 2, 1997.

* cited by examiner

*Primary Examiner*—John P. Sheehan
(74) *Attorney, Agent, or Firm*—Sughrue Mion, PLLC

(57) ABSTRACT

The invention concerns an iron-cobalt alloy, characterised in that it comprises in weight percentages: 10 to 22% of Co; traces to 2.5% of Si; traces to 2% of Al; 0.1 to 1% of Mn; traces to 0.0100% of C; a total of O, N and S content ranging between traces and 0.0070%; a total of Si, Al, Cr, Mo, V, Mn content ranging between 1.1 and 3.5%; a total of Cr, Mo and V content ranging between traces and 3%; a total of Ta and Nb content ranging between traces and 1%; the rest being iron and impurities resulting from production; and in that: $1.23\times(Al+Mo)\%+0.84\ (Si+Cr+V)\%-0.15\times(Co\%-15)\leqq 2.1$ and in that $14.5\times.\ (Al+Cr)\%+12\times(V+Mo)\%+25\times Si\%\geqq 21$. The inventive alloy is useful for making electromagnetic actuator mobile cores.

1 Claim, No Drawings

IRON-COBALT ALLOY, IN PARTICULAR FOR ELECTROMAGNETIC ACTUATOR MOBILE CORE AND METHOD FOR MAKING SAME

The invention relates to the field of magnetic iron-cobalt alloys. More specifically, it relates to iron-cobalt alloys intended to form the cores of electromagnetic actuators.

An electromagnetic actuator is an electromagnetic device that converts electrical energy into mechanical energy. Some actuators of this type are what are referred to as linear actuators that convert electrical energy into a linear displacement of a moving part. Such actuators are encountered in solenoid valves and in electro-injectors. A preferred application of such electro-injectors is the direct injection of fuel into internal combustion engines, especially diesel engines. Another preferred application relates to a very particular type of solenoid valve, used for electromagnetically controlling the valves of internal combustion (petrol or diesel) engines.

In these actuators, the electrical energy is supplied in a coil by a series of current pulses, creating a magnetic field which magnetizes a magnetic yoke which is not closed and therefore has a gap. The geometrical characteristics of the yoke make it possible to direct most of the magnetic field lines axially with respect to the gap region. Under the effect of the electrical pulse, the gap is subjected to a magnetic potential difference. The actuator also includes a core made to move by the action of the electrical current in the coil. This is because the magnetic potential difference introduced by the coil between the moving core at rest on one pole of the yoke and the opposite pole of the yoke creates an electromagnetic force on the magnetized core, via a magnetic field gradient. The magnetized core is thus set in motion. The rest position may also very well be located in the middle of the gap, by virtue of two symmetrical springs that favor, by their stiffness, the dynamics of the moving part (the case of electromagnetically controlled valves).

The moving core is set in motion with a phase shift with respect to the instant that the electrical pulses were created. For optimum operation of the actuator, it may be shown that it is necessary for the metal of which it is composed to possess a high electrical resistivity and a low coercive field. These conditions make it possible to obtain low induced currents in the yoke and the magnetic core, making it possible to rapidly achieve the minimum magnetization of the core that causes it to move. It is also important that the core possess a high saturation magnetization so as to permit, at the end of the pulse, a maximum force that is as high as possible, since it is this force which guarantees that the actuator is held in the open or closed position. This is particularly important when it is a question, for example, of completely interrupting the flow of a high-pressure fluid and/or of compensating for the return force of one or more springs.

These magnetic cores have various shapes and can be manufactured from rod or bar. In this case, they must have a high plastic deformability so as to be able to be deformed without any risk of fracture. It is favorable for the material to have an elongation at break of at least 35%. Such cores can also be manufactured by cutting rolled plate or sheet. In this case, they must have a high puncturability, for which hardness and mechanical strength minima are required. Good retention of the magnetic properties under the repeated mechanical shocks to which the core will be subjected is also necessary. These hardness and mechanical strength characteristics also favor effective cutting of the core. It is recommended for the material to have a hardness after annealing of more than 200 HV for these uses.

Three broad categories of alloys are conventionally used for forming the cores of electromagnetic actuators like the ones described above.

A first category consists of iron-silicon alloys containing from 2 to 3% silicon. They have the advantage of having relatively high resistivities. On the other hand, their saturation magnetization is relatively low.

A second category consists of iron-cobalt alloys having a high cobalt content of around 50%. Such alloys have a significantly higher saturation magnetization than the above iron-silicon alloys. On the other hand, their resistivity is somewhat lower. In addition, because of the very high cobalt content, these alloys are very expensive. Finally, their mechanical properties are not optimal, making it difficult to manufacture the cores.

A third category consists of iron-cobalt alloys containing about 6 to 30% cobalt and various other alloying elements. Document EP-A-715 320 gives an example of such alloys. It discloses iron-cobalt alloys for electromagnetic actuator cores comprising 6 to 30% cobalt and 3 to 8% of one or more elements chosen from chromium, molybdenum, vanadium and tungsten, the balance being iron. Preferably, the cobalt content is from 10 to 20% and the chromium, molybdenum, vanadium and/or tungsten content is from 4 to 8%. These alloys have good electrical resistivity, which may be greater than 50 μΩ.cm, but their saturation magnetization is relatively low, around 1.9 to 2 T, except for the versions with the highest cobalt contents (which are therefore the most expensive) in which this saturation magnetization may reach 2.3 T. In general, the coercive field of the alloys given as examples in that document is also high, substantially greater than 1.5 Oe. In general, the alloys given as examples in that document do not allow the optimum compromise between a high saturation magnetization, a low coercive field and a high resistivity to be achieved.

Document WO 96/19001 proposes the use of iron/cobalt alloys containing between 5 and 20% cobalt and having an aluminum and manganese or vanadium content that may reach several %, namely up to 7% aluminum and up to 8% manganese or 4% vanadium. Alloys disclosed in that document have a very high resistivity (greater than 60 μΩ.cm) and quite a high saturation magnetization (from 2 to 2.2 T). However, no precise information is provided about the mechanical properties of these alloys, nor about their coercive field.

The object of the invention is to provide iron/cobalt alloys that are particularly suitable for the economic manufacture of cores for electromagnetic actuators. These cores must exhibit a more favorable compromise between the various electromagnetic characteristics, namely the saturation magnetization, the resistivity and the coercive field, than with the existing materials. They must also have mechanical properties making them particularly easy to manufacture.

For this purpose, the subject of the invention is an iron-cobalt alloy, characterized in that it comprises, in percentages by weight:

- from 10 to 20% of Co;
- from traces to 2.5% of Si;
- from traces to 2% of Al;
- from 0.1 to 1% of Mn;
- from traces to 0.0100% of C;
- a sum of the O, N and S contents of between traces and 0.0070%;
- a sum of the Si, Al, Cr, V, Mo and Mn contents of between 1.1 and 3.5%, preferably between 1.5 and 3.5%;

a sum of the Cr, Mo and V contents of between traces and 3%;

a sum of the Ta and Nb contents of between traces and 1%;

the balance being iron and impurities resulting from the smelting, in that:

$$1.23(Al+Mo)\%+0.84(Si+Cr+V)\%-0.15(Co\ \%-15) \leqq 2.1$$

and in that:

$$14.5(Al+Cr)\%+12(V+Mo)\%+25Si\ \% \geqq 21, \text{ preferably} \geqq 40.$$

Preferably, this iron-cobalt alloy contains 14 to 20% Co and the sum of the Ta and Nb contents is between 0.05 and 0.8%.

According to a variant of the invention, the sum of the Cr and V contents is between 1.1 and 3%, preferably between 1.5 and 3%, and the sum of the Si, Al and Mo contents is between traces and 1% in order to obtain an elongation at break of at least 35%.

According to another variant of the invention, the sum of the Si and Al contents is between 1 and 2.6% and the sum of the Cr, V, Mo, Ta and Nb contents is between traces and 2% in order to obtain a hardness of at least 200 HV after annealing.

The saturation magnetization of the alloys according to the invention is at least 2.1 T at 150° C. and at least 2.12 T at 20° C., their resistivity is at least 35 μΩ.cm at 150° C. and at least 31 μΩ.cm at 20° C., and their coercive field is less than 1.5 Oe at 20° C. and at 150° C., and preferably less than or equal to 1 Oe.

The subject of the invention is also a rolled bar, rod, plate or sheet made of iron-cobalt alloy, characterized in that said alloy is of the above type and in that the bar, rod, plate or sheet has a preferential <100> axis fiber texture in the case of a bar or rod, or a strong <100> texture component in the case of a rolled plate or sheet, deviating by less than 20° with respect to the hot rolling direction for at least 30% (by volume of the material), preferably for at least 50%, of the grains.

The subject of the invention is also a process for producing a rolled bar, rod, plate or sheet of the above type, characterized in that a rolled bar, rod, plate or sheet is produced from a blank made of an alloy according to the invention by carrying out a rolling operation starting in the austenitic phase and finishing in the ferritic phase, the thickness reduction suffered by the bar, rod, plate or sheet in the ferritic phase being at least 30%, preferably at least 50%, and in that an optional subsequent annealing treatment is carried out at a temperature below the austenitic transformation temperature.

The subjects of the invention are also a moving core for an electromagnetic actuator, characterized in that it has been manufactured from a rolled bar or rod or plate or sheet according to the above process, and an electromagnetic actuator comprising a moving core made of an iron-cobalt alloy, characterized in that said core is of the above type and in that it has a preferential <100> axis texture, this axis being approximately parallel to the principal direction of the excitation field.

The subject of the invention is also an injector for an internal combustion engine controlled by electronic regulation, comprising an electromagnetic actuator having a high volume power, a short response time and high reliability in use, of the above type.

Finally, the subject of the invention is an electromagnetic actuator for the electronically controlled valves of an internal combustion engine, characterized in that it is of the above type.

As will have been understood, the iron/cobalt alloy according to the invention falls within the category of Fe—Co alloys having a low or medium cobalt content, and has relatively moderate contents of other alloying elements. However, these alloying elements must be present in well-defined respective proportions. It is only under these conditions that, for these alloys and for the cores of electromagnetic actuators that are produced therefrom, optimum properties are obtained both from the magnetic standpoint and from the mechanical standpoint, for a material cost (associated with the presence of cobalt) which is very moderate compared with the Fe—Co alloys containing 50% cobalt.

The alloys according to the invention have resistivities similar to those of iron/silicon alloys containing 2 to 3% silicon. This resistivity at 150° C. is greater than 35 μΩ.cm, so as to preserve good reactivity of the actuator to the stresses to which it is subjected at its operating temperature. At 20° C., this resistivity is greater than 31 μΩ.cm. At the same time, this good reactivity of the actuator is also due to a low coercive field, limited to 1.5 Oe at 20° C. and 150° C. This low value of the coercive field is obtained according to the invention by imposing on the alloy a carbon content of less than 0.0100% and a total oxygen, nitrogen and sulfur content limited to 70 ppm. This low coercive field reduces the pulse time further. It is also advised, for the same purpose, to confer on the part from which the core will be manufactured a preferential <100> axis texture so that, in the core during use, this preferential texture is approximately parallel to the principal excitation direction of the field.

Moreover, the alloys according to the invention have a saturation magnetization at 150° C. of more than 2.1 T. This value is substantially greater than that usually found in iron/silicon alloys containing 3% silicon. At 20° C., the saturation magnetization of the alloys according to the invention is greater than 2.12 T.

The differences in the values of the above-mentioned parameters between 20 and 150° C. are explained by the fact that the coercive field and the saturation magnetization vary between 20 and 150° C. by at most 4% and 1% respectively, whereas the resistivity increases between 20 and 150° C. by about 16%. This property therefore varies substantially and the effect of temperature must be taken into account: a minimum resistivity of 35 μΩ.cm at 150° C. corresponds to a minimum resistivity of 31 μΩ.cm at 20° C. The coercive field at 150° C. is always about 4% lower than it is at 20° C.; hence if it is low enough at 20° C. (1.5 Oe at most) it will be so a fortiori at 150° C. On the other hand, the saturation magnetization decreases when the temperature increases; hence, to guarantee a saturation magnetization of greater than or equal to 2.1 T at 150° C., the saturation magnetization at 20° C. must be more than 1% higher than the 150° C. value, i.e. greater than or equal to 2.12 T.

Finally, the alloys according to the invention have mechanical properties that are particularly suitable to the production of cores for electromagnetic actuators.

In certain preferred examples, the alloys have a high capability of undergoing plastic deformation by forging or stamping or drawing, since they have a maximum elongation at break of at least 35%. In another version of the alloys according to the invention, these alloys have a high cutability and machineability, by virtue of their hardness after annealing, which is at least 200 HV.

The iron/cobalt alloys according to the invention necessarily have the following features. All the percentages are percentages by weight.

The cobalt content is between 10 and 22%, and preferably between 14 and 20%, so as to significantly increase the saturation magnetization relative to iron/silicon alloys, while maintaining a high resistivity. Moreover, the 22% limitation on the cobalt content gives mechanical properties and manufacturing costs that are more favorable than in the case of iron/cobalt alloys containing 50% cobalt.

The silicon content does not exceed 2.5%; the aluminum content does not exceed 2%; each of the chromium, molybdenum and vanadium contents does not exceed 3%, nor does the sum of their contents; the manganese content is between 0.1 and 1%, preferably between 0.1 and 0.5%, in order to facilitate hot conversion. Each of these elements (apart from manganese) may be present only as traces resulting from the smelting.

Furthermore, the sum of the silicon, aluminum, chromium, vanadium, molybdenum and manganese contents is between 1.1 and 3.5%, and preferably between 1.5 and 3.5%. It is under these conditions that a resistivity of the alloy equivalent to that of iron/silicon alloys containing 2 to 3% silicon is obtained. Moreover, the contents of these elements must satisfy the following two equations:

$$1.23(Al+Mo)\%+0.84(Si+Cr+V)-0.15(Co\%-15)\% \leqq 2.1 \quad (1)$$

so as to ensure that the saturation magnetization is greater than or equal to 2.1 T at 150° C. and greater than or equal to 2.12 T at 20° C.;

$$14.5(Al+Cr)\%+12(V+Mo)\%+25Si\% \geqq 21, \text{ preferably} \geqq 40 \quad (2)$$

so as to ensure a resistivity greater than or equal to 35 μΩ.cm at 150° C. and greater than or equal to 31 μΩ.cm at 20° C.

Moreover, the sum of the chromium, molybdenum and vanadium contents must be at most 3%, so as not to degrade the saturation magnetization of the material.

The tantalum and niobium contents, together with the sum of their contents, must each be less than or equal to 1%. Preferably, the sum of these contents is between 0.05 and 0.08%. The function of the tantalum is to increase the ductility of the alloy, and the niobium to increase the mechanical strength, the wear resistance and the resistivity. The 1% upper limit is justified by the need to avoid degrading the saturation magnetization of the material. These elements may be present only as traces resulting from the smelting.

The carbon content must be less than or equal to 100 ppm, and the sum of the oxygen, nitrogen and sulfur contents must be less than or equal to 70 ppm. These conditions make it possible to decrease the coercive field and increase the dynamic permeability of the alloy. These carbon, oxygen, nitrogen and sulfur elements are regarded as impurities and may be present only as traces resulting from the smelting.

When the alloy is intended to undergo a forging or stamping or drawing operation, for which it is desirable to have a high maximum plastic elongation (greater than or equal to 35%), the alloy must preferably satisfy the following two conditions:

- the sum of the chromium and vanadium contents must be between 1.1 and 3%, preferably between 1.5 and 3%;
- the sum of the silicon, aluminum and molybdenum contents must be between traces and 1%.

Such cold forging or stamping and drawing operations are carried out on an alloy initially in the form of bar, rod or thick (at least 1 mm) plate.

When the core is prepared from bar, plate or sheet, and when this bar, plate or sheet has to be cut or machined, it is preferable that the composition of the alloy satisfy the following two characteristics:

- the sum of the silicon and aluminum contents is between 1 and 2.6%; and
- the sum of the chromium, vanadium, molybdenum, tantalum and niobium contents is between traces and 2%.

In this way, an alloy whose hardness is greater than 200 HV after annealing is obtained.

Table 1 gives, for examples of alloys according to the invention and alloys according to the prior art, their chemical composition and the following properties at 20° C. resulting from these compositions: elongation at break, hardness after annealing, saturation magnetization, resistivity and coercive field. The balance to 100% of the compositions consists of iron and impurities resulting from the smelting. Also indicated are the results of the calculation of the left-hand side of equations (1) and (2).

| Heat | | % Co | % Si | % Al | % Ta | % Cr | % V | % Mo | % C | % O + N + S | Temperature $T_{\alpha/\gamma}$ (° C.) |
|---|---|---|---|---|---|---|---|---|---|---|---|
| Invention | 1 | 18.00 | 1.67 | 0.38 | 0.294 | <0.1 | <0.05 | <0.05 | 0.0030 | 0.0052 | 960 |
| | 2 | 18.07 | 1.65 | 0.44 | <0.002 | <0.1 | <0.05 | 0.185 | 0.0034 | 0.0044 | 970 |
| | 3 | 18 | 1.2 | 0 | <0.002 | <0.1 | <0.05 | <0.05 | 0.0044 | 0.0057 | 930 |
| | 4 | 18 | 0 | 0 | <0.002 | 2 | <0.05 | <0.05 | 0.0038 | 0.0053 | 920 |
| | 5 | 18 | 0.4 | <0.1 | <0.002 | 2.7 | <0.05 | <0.05 | 0.0023 | 0.0046 | 930 |
| | 6 | 18 | <0.1 | 0.3 | <0.002 | 2.7 | <0.05 | <0.05 | 0.0035 | 0.0039 | 930 |
| | 7 | 18 | <0.1 | <0.1 | <0.002 | 2.9 | <0.05 | <0.05 | 0.0041 | 0.0036 | 930 |
| | 8 | 18 | <0.1 | <0.1 | 0.2 | 2.9 | <0.05 | <0.05 | 0.0029 | 0.0041 | 930 |
| Controls | 9 | 49 | <0.1 | <0.1 | <0.002 | 0.05 | 2 | <0.05 | <0.012 | <0.0050 | — |
| | 10 | 27 | 0.127 | <0.1 | <0.002 | 0.5 | 0.012 | <0.05 | <0.020 | <0.0050 | — |
| | 11 | <0.1 | 3 | <0.1 | <0.002 | <0.1 | <0.05 | <0.05 | <0.010 | <0.0100 | — |
| | 12 | 19.58 | <0.1 | <0.1 | 0.159 | <0.1 | 1.6 | <0.05 | 0.0028 | 0.0080 | 920 |
| | 13 | 18.02 | <0.1 | <0.1 | <0.002 | 2.72 | <0.05 | <0.05 | 0.0030 | 0.0077 | 920 |
| | 14 | 17.96 | <0.1 | <0.1 | 0.21 | 2.71 | <0.05 | <0.05 | 0.0024 | 0.0077 | 920 |
| | 15 | 15.12 | 1.51 | 1.38 | <0.002 | <0.1 | <0.05 | <0.05 | 0.0018 | 0.0035 | 1000 |
| | 16 | 15.02 | 0.98 | 1.55 | <0.002 | <0.1 | <0.05 | <0.05 | 0.0011 | 0.0030 | 990 |

-continued

| | | | | | | | | | | |
|---|---|---|---|---|---|---|---|---|---|---|
| 17 | 15.08 | 1.5 | 1.05 | <0.002 | <0.1 | <0.05 | <0.05 | 0.0027 | 0.0055 | 980 |
| 18 | 15.1 | <0.1 | <0.1 | <0.002 | <0.1 | <0.05 | <0.05 | 0.0015 | 0.0030 | 920 |
| 19 | 15.03 | 1 | <0.1 | <0.02 | <0.1 | <0.05 | <0.05 | 0.0100 | 0.0046 | 930 |
| 20 | 18.45 | <0.1 | <0.1 | <0.02 | <0.1 | 3.2 | <0.05 | 0.0014 | 0.0050 | 970 |

| | Heat | Elongation at break (%) | Hardness after annealing (HV) | $B_s$ at 20° C. (T) | ρ at 20° C. (μΩ · cm) | $H_c$ at 20° C. (Oe) | Eq. (1) | Eq. (2) |
|---|---|---|---|---|---|---|---|---|
| Invention | 1 | 36 | 227 | 2.12 | 37.2 | 0.9 | 1.42 | 47.3 |
| | 2 | 30 | 223 | 2.12 | 37.3 | 0.8 | 1.73 | 50 |
| | 3 | 26 | 212 | 2.24 | 33 | 0.6 | 0.56 | 30 |
| | 4 | 36 | 152 | 2.25 | 35 | 1.3 | 1.43 | 29 |
| | 5 | 35 | 162 | 2.14 | 42.5 | 1 | 2.03 | 49 |
| | 6 | 39 | 151 | 2.13 | 41 | 0.9 | 2.08 | 43.5 |
| | 7 | 38 | 146 | 2.16 | 40.5 | 0.6 | 1.87 | 42 |
| | 8 | 45 | 143 | 2.15 | 41 | 0.9 | 1.87 | 42 |
| Controls | 9 | <5 | 200 | 2.35 | 40 | 0.5 to 1 | — | — |
| | 10 | 10 to 25 | 140 | 2.35 | 20 | 0.5 | — | — |
| | 11 | 15 to 25 | 220 | 2.03 | 45 | 0.5 | — | — |
| | 12 | 34 | 150 | 2.22 | 29.6 | 2.7 | — | 19 |
| | 13 | 38 | 147 | 2.17 | 38.5 | 3.05 | 1.8 | 39 |
| | 14 | 43 | 145 | 2.16 | 37 | 2.8 | 1.8 | 39 |
| | 15 | 26 | 235 | 2.08 | 42 | 0.4 | 3 | 57.8 |
| | 16 | 28 | 225 | 2.10 | 40 | 0.3 | 2.75 | 47 |
| | 17 | 23 | 231 | 2.10 | 40 | 0.4 | 2.55 | 52.7 |
| | 18 | 32 | 157 | 2.25 | 20 | 0.5 | 0 | 0 |
| | 19 | 28 | 192 | 2.21 | 30 | 0.6 | 0.8 | 20 |
| | 20 | 32.5 | 165 | 2.17 | 37 | 0.6 | 2.04 | 38 |

Control alloy 9 is an iron/cobalt alloy containing about 50% cobalt. Its magnetic properties are excellent, as is its hardness which makes it able to be cut or machined. On the other hand, it has an extremely low elongation at break, which makes it unsuitable for undergoing large plastic deformations. In addition, it is an extremely expensive alloy.

Control example 10 is an iron/cobalt alloy containing about 30% cobalt. Compared with the previous alloy, its resistivity is very substantially lower. Furthermore, although its elongation at break is better, albeit not excellent, this alloy has a substantially lower hardness after annealing which makes it less suitable for undergoing cutting or machining.

Control alloy 11 is an iron/silicon alloy containing 3% silicon. It has satisfactory resistivity and coercive field values; however, its saturation magnetization is relatively low. Furthermore, its elongation at break remains very limited.

Control alloy 12 is an alloy having about 20% cobalt, and containing vanadium. Its composition satisfies equation (1), and it therefore has a good saturation magnetization. However, it does not satisfy equation (2), and its resistivity is therefore mediocre. In addition, its O+N+S content is relatively high, which gives it too high a coercive field.

Control alloy 13 is an 18% cobalt alloy containing chromium. It satisfies equation (2) (if the elements Al, V, Mo and Si inevitably present are taken as impurities) and satisfies equation (1). Its saturation magnetization and its resistivity are therefore satisfactory. Its high elongation at break would make it suitable for being formed by plastic deformation. However, its O+N+S content is high, which gives it too high a coercive field.

Control alloy 14 is similar to the previous one, except that tantalum has been added thereto. The elongation at break is further improved, but the coercive field remains too high for this composition to fall within the scope of the invention.

Control alloy 15 is a 15% cobalt alloy, also containing silicon and aluminum. It satisfies equation (2), which gives it a good resistivity, but not equation (1), hence a saturation magnetization a little too low compared with what is desired. It should be noted that its O+S+N content is low, which gives it a very low coercive field, and the silicon and aluminum give it a high hardness after annealing.

Control alloys 16 and 17 have properties similar to the previous one. They do not satisfy equation (1) because of too low a cobalt content compared with the total of the silicon and aluminum contents, and their saturation magnetization at 20° C. is slightly too low.

Control alloy 18 is an iron-cobalt alloy containing 15% cobalt, but containing no other alloying element in significant amounts. Although its saturation magnetization and its coercive field are good (equation (1) is satisfied and its O+N+S content is low), its resistivity is mediocre (equation (2) is not satisfied). In addition, its mechanical properties are not particularly good, whether in respect of the elongation at break or in respect of the hardness after annealing.

Control alloy 19 is an iron-cobalt alloy containing 15% cobalt, but containing only 1% silicon. As regards this alloy, the same comments may be made as for alloy 16, with the exception that the presence of silicon improves the hardness and the resisitivity, but without thereby bringing the latter to a sufficient level.

Control alloy 20 is an iron-cobalt alloy containing 18% cobalt and 3.2% vanadium. Its electromagnetic properties are good, but its elongation at break is insufficient because of the presence of excess vanadium compared with the permitted maximum amount (3%).

Among alloys 1–8 according to the invention, alloys 1–3 have a high hardness after annealing, greater than 210 HV, which therefore makes them particularly suitable for being cut or machined. It will therefore be preferable to use them to form bar, plate or sheet, from which the desired parts will be manufactured. These are iron-cobalt alloys containing about 15 or 18% cobalt and significant amounts of silicon and optionally aluminum. In addition, alloy 1 contains tantalum and alloy 2 molybdenum; alloy 3 has no additional alloying elements in significant amounts. These alloys have excellent electromagnetic properties, in terms of both saturation magnetization and resistivity, and therefore represent a very good compromise between the various requirements of the envisioned applications. Finally, the presence of tantalum and molybdenum in alloys 1 and 2 gives them quite high elongations at break, making these alloys also capable of being formed by forging or stamping or drawing under conditions which would be acceptable or which, in the case of alloy 1, would even be clearly good. Typically, for this category of alloys, a composition comprising 18% cobalt, 0.5 to 1% chromium+vanadium, 0.05 to 0.5% tantalum+silicon and 1 to 2.5% silicon+aluminum+molybdenum is chosen.

Alloys 4–8 according to the invention have a high elongation at break (at least 35%) which makes them suitable for being formed by forging or stamping or drawing. Preferably, they will be used to form bar or rod from which the desired parts will be manufactured. These are iron-cobalt alloys containing about 18% cobalt, but containing little or no silicon and aluminum. On the other hand, they contain chromium (2 to 2.9%). This element could be replaced, at least in part, by molybdenum and/or vanadium. Their electromagnetic properties represent the same favorable compromise between the various requirements as alloys 1–3. Typically, for this category of alloys, a composition comprising 18% cobalt, 2 to 3% chromium, 0 to 1% vanadium, 0.05 to 0.5% tantalum+silicon and 0 to 0.5% silicon+aluminum+molybdenum is chosen.

Once the alloy according to the invention has been obtained, in the form of bar, rod, plate or sheet, if it is desired to use this alloy to produce electromagnetic actuators (or any other part for which similar properties would be required), it is important to make the metal undergo a thermomechanical treatment giving it the required optimum texture. The purpose of this treatment is to obtain, for at least 30% and preferably at least 50% (by volume) of the material, grains or crystals having a crystallographic orientation comprising a <100> axis that deviates by less than 20° with respect to the hot or cold rolling direction. If certain <100> axes of the crystals are brought close to the principal directions of use of the magnetic flux by a particular texture, the magnetic properties of the soft magnetic steels and alloys are significantly improved. In the case of the alloys of the invention made in the form of rolled plate or sheet, these must have a preferential texture of the {100} or {110} type parallel to the rolling plane, the proportion in the volume of the material and the <100> orientation with respect to the rolling direction of which must meet the abovementioned criteria.

In the alloys of the invention, one process for obtaining a texture satisfying these characteristics is as follows.

The blank in the form of bar, rod, plate or sheet, the composition of which was defined above, undergoes an austeno-ferritic hot rolling operation. The expression "austeno-ferritic rolling" is understood to mean rolling that starts in the austenitic phase, and therefore above the $\alpha \rightarrow \alpha+\gamma$ transformation temperature ($T_{\alpha/\gamma}$, which is specified for each alloy given as an example in table 1), and ends in the ferritic phase, and therefore below $T_{\alpha/\gamma}$. This hot rolling must include a reduction step with a deformation ratio of at least 30% (and preferably at least 50%) when the alloy is in the ferritic phase (the deformation ratio being defined by the (initial cross section—final cross section)/(initial cross section) ratio. For example, if it is desired to obtain a bar 20 mm in diameter, it is necessary, during hot rolling, to be in the ferritic phase with an intermediate diameter of at least 24 mm, preferably at least 28 mm. Likewise, if it is desired to obtain a plate 2.5 mm in thickness, it is necessary, during hot rolling, to be in the ferritic phase with an intermediate thickness of at least 3.6 mm, preferably at least 5 mm.

Moreover, the annealing treatments optionally carried out after the hot rolling must never raise the product to a temperature of above $T_{\alpha/\gamma}$, this temperature varying from 930 to 990° C. in the case of the alloys according to the invention indicated in table 1.

Finally, since the most favorable texture is obtained mainly in the upper layers of the product, it is advised to limit as far as possible any surface removal of material during subsequent pickling or polishing operations. Preferably, the reduction in mass of the products following these operations should not exceed 10%, or better still 5%.

As mentioned, a preferred application of the alloys according to the invention is the manufacture of cores for electromagnetic actuators. Such compact, rapid and reliable actuators comprising such cores may advantageously be used in direct-injection internal combustion engines, especially diesel engines, and in moving parts for electromagnetic actuators that control the movement of the valves of internal combustion engines.

The invention claimed is:

1. A process for producing a rolled bar, rod, plate or sheet made of iron-cobalt alloy, characterized in that said alloy comprises, in percentages by weight:

from 10 to 20% of Co;

from traces to 2.5% of Si;

from traces to 2% of Al;

from 0.1 to 1% of Mn;

from traces to 0.0100% of C;

a sum of the O, N and S contents of between traces and 0.0070%;

a sum of the Si, Al, Cr, V, Mo and Mn contents of between 1.1 and 3.5%, preferably between 1.5 and 3.5%;

a sum of the Cr, Mo and V contents of between traces and 3%;

a sum of the Ta and Nb contents of between traces and 1%;

the balance being iron and impurities resulting from the smelting, in that $1.23(Al+Mo)\%+0.84(Si+Cr+V)\%-0.15(Co\%-15) \leqq 2.1$, in that $14.5(Al+Cr)\%+12(V+Mo)\%+25Si\% \geqq 21$, preferably $\geqq 40$, in that the bar, rod or plate has preferential <100> axis fiber texture deviating by less than 20° with respect to a hot rolling direction, for at least 30% (by volume of the material), preferably for at least 50%, of the grains wherein the rolled bar, rod, plate or sheet is produced from a blank made of said alloy by carrying out a rolling operation starting in the austenitic phase and finishing in the ferritic phase with a deformation ratio in the ferritic phase of at least 30%, and in that an optional subsequent annealing treatment is carried out at a temperature below the austenitic transformation temperature.

* * * * *